US006186930B1

(12) United States Patent
Ignaczak

(10) Patent No.: US 6,186,930 B1
(45) Date of Patent: Feb. 13, 2001

(54) PUSH-UP TRAINER

(76) Inventor: David P. Ignaczak, 115 Scenic View Dr., Sarver, PA (US) 16055-9581

( * ) Notice: Under 35 U.S.C. 154(b), the term of this patent shall be extended for 0 days.

(21) Appl. No.: 09/562,079

(22) Filed: May 1, 2000

(51) Int. Cl.[7] ..... A63B 71/00
(52) U.S. Cl. ..... 482/141; 482/148
(58) Field of Search ..... 482/141, 38, 908, 482/126, 130, 37, 148, 49, 100, 115, 142

(56) References Cited

U.S. PATENT DOCUMENTS

| | | | |
|---|---|---|---|
| 3,115,338 | 12/1963 | Acs et al. . | |
| 4,351,525 | 9/1982 | Rozenblad . | |
| 4,358,106 * | 11/1982 | Shadford | 482/141 |
| 4,610,448 | 9/1986 | Hill . | |
| 5,205,802 | 4/1993 | Swisher . | |
| 5,226,868 | 7/1993 | Montgomery . | |
| 5,607,380 | 3/1997 | Duty . | |
| 5,713,823 * | 2/1998 | Waldendzak et al. | 482/141 |

FOREIGN PATENT DOCUMENTS

| | | |
|---|---|---|
| 2270636 | 3/1994 | (GB) . |
| 4229970 | 3/1994 | (DE) . |

* cited by examiner

*Primary Examiner*—Stephen R. Crow
(74) *Attorney, Agent, or Firm*—Richard C. Litman

(57) ABSTRACT

A push-up trainer having a base and a pair of handgrip assemblies. The handgrip assemblies are each slidably mounted to the base, allowing for lateral movement of the handgrips. Each handgrip assembly allows for rotation of each handgrip around a vertical axis and around its horizontal lengthwise axis. Each of the sliding and rotational motions may selectively be allowed or locked out using a spring biased pin.

11 Claims, 8 Drawing Sheets

PUSH-UP TRAINER

BACKGROUND OF THE INVENTION

1. Field of the Invention

The present invention is a pushup trainer having slidably and rotatably mounted handgrips, allowing the user to increase the benefits of his workout by forcing the user to control the rotation and lateral movement of the handgrips while performing pushups.

2. Description of the Related Art

The benefits of performing pushups for increased upper body development are well known. Pushups are one of the best exercises for strengthening the triceps, pectorals, and deltoids. Unlike weight training, pushups can be performed without the need for a spotter, and place less stress on the joints.

Several other inventors have proposed various devices for increasing the benefits of performing pushups. However, no other inventor within the knowledge of the present inventor has proposed a pushup trainer having the advantages of the present invention. Specifically, no other pushup trainer provides a pair of handgrips which can rotate around both horizontal and vertical axes, and which also slide laterally, and which allows each individual rotational or lateral motion to be individually locked out or permitted without affecting the other possible motions.

One example of a pushup trainer is U.S. Pat. No. 3,115,338, issued to Katherine and Peter Acs on Dec. 24, 1963. This patent describes a pair of handles having a flat base. The base rests on the floor, while a person performing pushups grips the handles. The handles may have a base with a suction cup, so that the suction cup can attach to a wall, allowing the user to grasp the grip to maintain his balance. A third embodiment has a hook-shaped bolt, allowing the handles to hang from an overhead support for performing pullups.

U.S. Pat. No. 4,351,525, issued to William L. Rozenblad on Sept. 28, 1982, describes a pair of wood platforms, each having a non-skid surface on the bottom, and a U-shaped handle on top. The handles may be used in pairs for performing pushups, or only a single handle may be used to provide for a more difficult pushup.

U.S. Pat. No. 4,610,448, issued to David L. Hill on Sept. 9, 1986, describes a pushup training device having both handgrips pivotally attached to the same base. The U-shaped bracket supporting the handgrips can rotate around a vertical axis, and the handgrips can rotate around a longitudinal horizontal axis.

U.S. Pat. No. 5,205,802, issued to William J. Swisher on Apr. 27, 1993, describes a pushup training device having a single elongated base for a pair of handgrips. The base includes holes positioned at various differences from its vertical center, allowing the handgrips to be positioned at a desired distance from the center. The handgrips can rotate around a vertical axis as the user performs pushups.

U.S. Pat. No. 5,226,868, issued to Calvin W. Montgomery on Jul. 13, 1993, describes a pushup training device having a board and two C-shaped handles. The board has holes in various positions for attaching the handles. Only one end of the handles attaches to the board, allowing the handles to rotate around a vertical axis at the attachment point.

U.S. Pat. No. 5,607,380, issued to John E. Duty on Mar. 4, 1997, describes a pushup training device having a pair of bases, with each base supporting a gripping bar. The gripping bar may be positioned at various desired angles. An elastic band extends from one handgrip to the other, passing over the back of the neck, to provide a workout for the neck muscles as the user pushes himself up.

U.K. Pat. No. 2,270,636, published on Mar. 23, 1994, describes a pushup training device having a board and a pair of U-shaped handles. The board has several sets of holes, allowing the user to position each of the handles in a pair of holes. The user can thereby set the handles a desired distance apart.

German Pat. No. 4,229,970, published on Mar. 10, 1994, describes an exercise device.

None of the above patents describes a pushup trainer allowing the user to selectively lock out or allow horizontal rotation, vertical rotation, or lateral movement of the handgrips while performing pushups. None of the above inventions and patents, taken either singularly or in combination, is seen to describe the instant invention as claimed. Thus a push-up trainer solving the aforementioned problems is desired.

SUMMARY OF THE INVENTION

The present invention is a pushup trainer having a base and a pair of handgrip assemblies. The handgrip assemblies each include a sliding member slidably mounted within the base, a rotating plate rotatably attached to the top of the sliding member, a grip brace extending upward from the rotating plate, and a handgrip rotatably secured between the arms of the brace.

The base is an elongated member having a top surface surrounded by a lip to secure the sliding members in place. The top surface is preferably made of material having a low coefficient of friction. The top surface also includes a plurality of holes extending down its length, for engaging a retractable locking pin on each handgrip assembly's sliding member. The length of the base is sufficient to allow pushups to be performed with a wide variety of arm positions.

A pair of grip assemblies are slidably attached to the base, within the lip around the edges of the base. Preferably, the bottom of the sliding members is made from a material having a low coefficient of friction. A locking pin is located within the sliding member. The locking pin is spring-biased in the locked position, wherein its tip is within one of the holes in the base, preventing sliding movement. A preferred and suggested locking pin has a cutout at the bottom edge of a knob at the top surface, with a shelf attached to the base and fitting within this cutout when the pin is in the locked position. Raising the locking pin, and rotating the pin so that the knob's cutout is not aligned with the shelf will allow the bottom edge of the pin's knob to rest on the shelf, holding the pin in the unlocked position and allowing sliding movement.

A rotating plate is mounted on top of the sliding plate, secured by a vertical shaft acting as the rotational axis. The rotating plate includes a locking pin which is spring-biased in a locked position, wherein the end of the pin fits within one of several holes in the sliding member, preventing rotational movement. Like the sliding member's locking pin, a preferred and suggested locking pin has a cutout at the bottom edge of a knob at the top surface, with a shelf attached to the base and fitting within this cutout when the pin is in the locked position. Raising the locking pin, and rotating the pin so that the knob's cutout is not aligned with the shelf will allow the bottom edge of the pin's knob to rest on the shelf, holding the pin in the unlocked position and allowing sliding movement.

A brace having a pair of arms extends upward from the rotating plate, with a handle mounted between the arms. The handle includes a horizontal locking pin which also serves as a rotational axis. One end of the locking pin includes a square knob, fitting within a square hole in one arm and in the handle. The locking pin is spring-biased in the locked position, wherein the square knob is within the square holes, preventing rotation. Pulling the square knob outward and rotating it 45° secures the locking pin in the unlocked position, permitting the handle to rotate.

When performing pushups using the present invention, the user must use his muscles to control any sliding or rotational motion which is not locked out by a pin. The user must prevent the handgrips from sliding outward or inward, rotating around a horizontal axis, or rotating around a vertical axis, all while performing a standard pushup. This added requirement increases the number of muscles involved in the workout, thereby exercising and strengthening the additional muscles. The ability to selectively and individually lock out the lateral sliding, vertical rotation, or horizontal rotation of each gripping assembly allows the user to control the amount and type of additional muscular effort will be necessary to perform the pushups.

If the user chooses to lock out the rotation of the rotating plate, he may do so with the handle oriented either parallel to the base, corresponding to a palm-down or palm-up pushup position, or perpendicular to the base, corresponding to a palm-inward pushup position. It is well known in the field of exercise that changing the orientation of the hands alters the alignment of the muscles in the arm. With the palms facing downward, the arms are in a position where they can perform a pushing motion most efficiently. With the palms facing inward, the resulting pushup is effective for activity-specific muscular training, and results in an arm motion similar to a karate vertical fist punch.

Accordingly, it is a principal object of the invention to provide a pushup trainer having a pair of handgrip assemblies allowing for lateral motion, horizontal rotation, and vertical rotation of the handgrips.

It is another object of the invention to provide a pushup trainer allowing the user to selectively allow or lock out the lateral motion, horizontal rotation, or vertical rotation of the handgrips.

It is a further object of the invention to provide a pushup trainer which allows the user to choose to control the lateral movement, horizontal rotation, and vertical rotation of the handgrips using muscular strength while performing pushups, thereby increasing the benefits of performing the pushups.

Still another object of the invention is to provide a pushup training device having handles which may be oriented so that they are parallel to the base, perpendicular to the base, or any angle therebetween, correspond to the muscle alignment in the arm most closely resembling that which will occur during the user's athletic endeavors.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
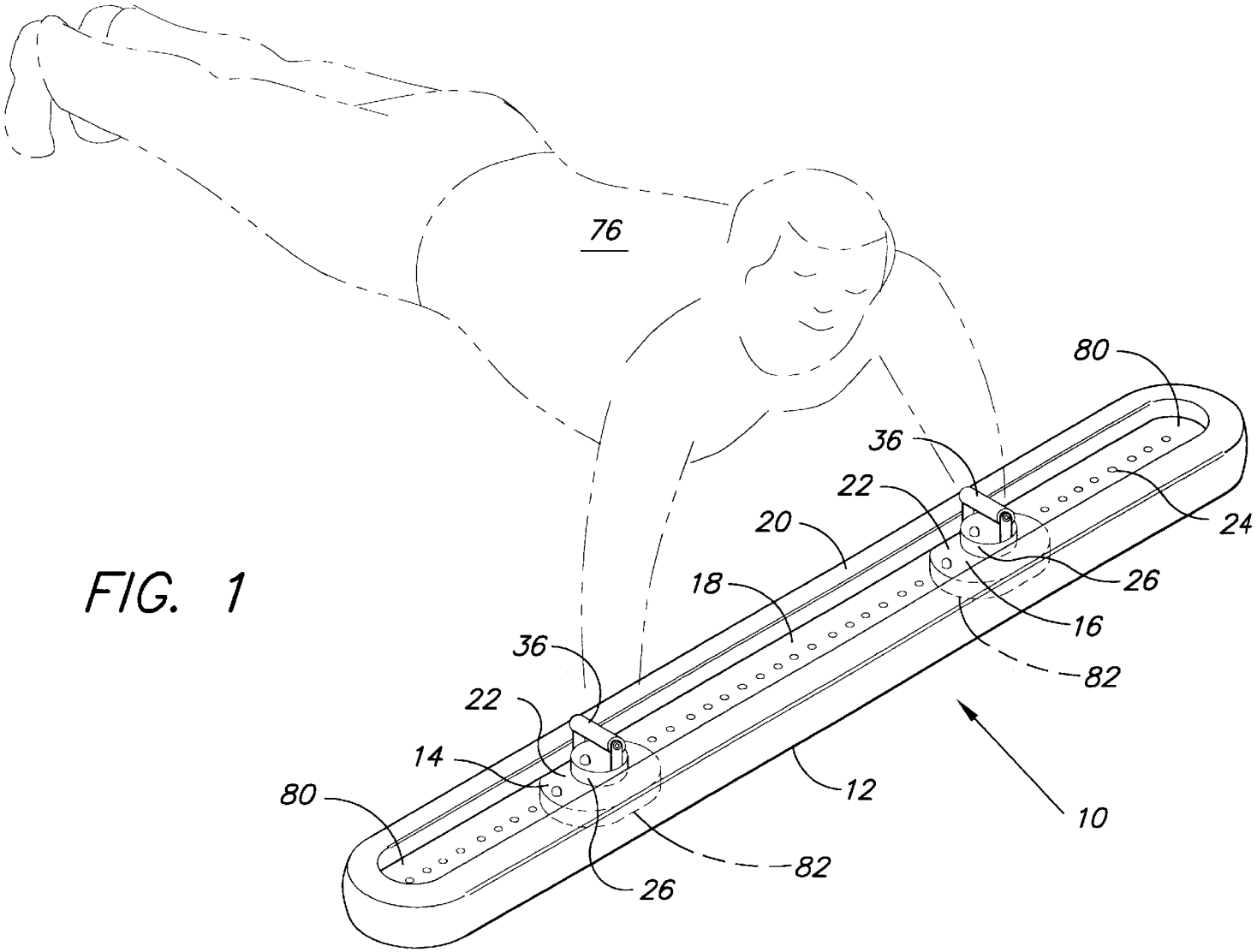
FIG. 1 is an environmental, perspective view of a push-up trainer according to the present invention.
Figure 2:
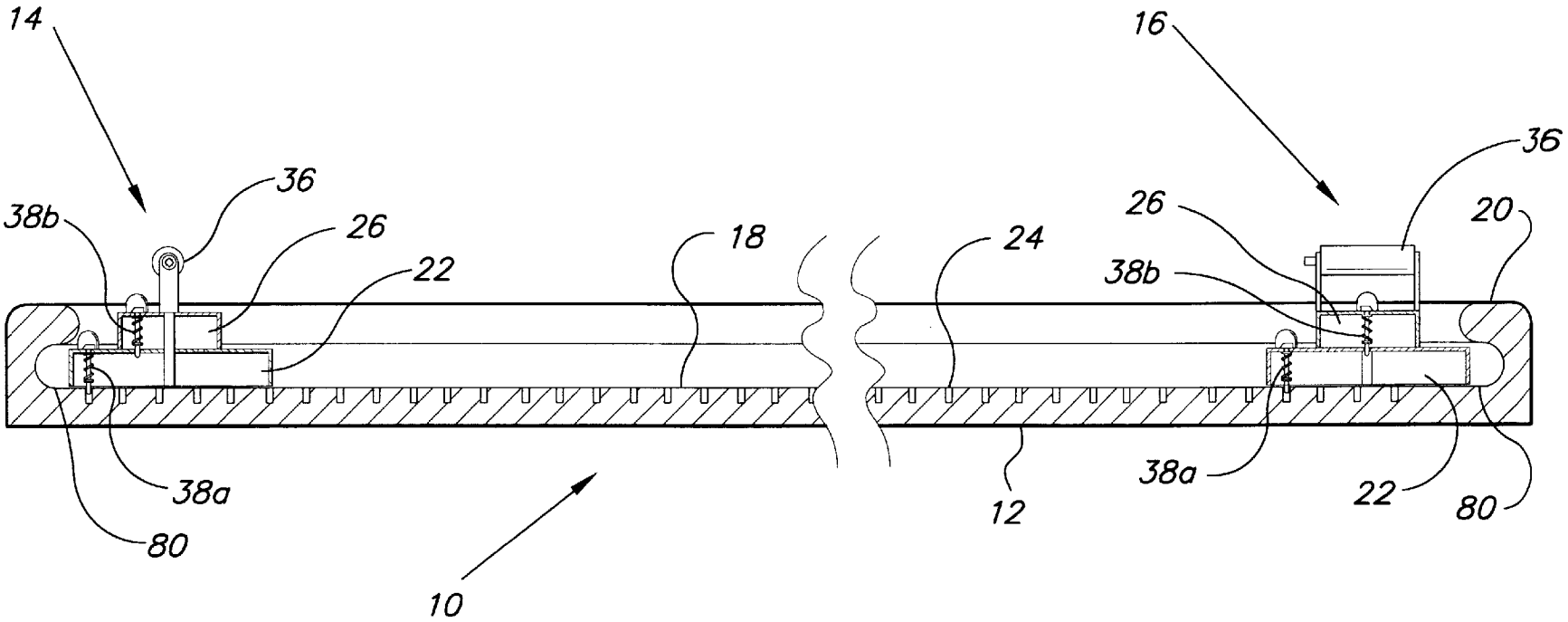
FIG. 2 is a cross sectional view of a push-up trainer according to the present invention.
Figure 3A:
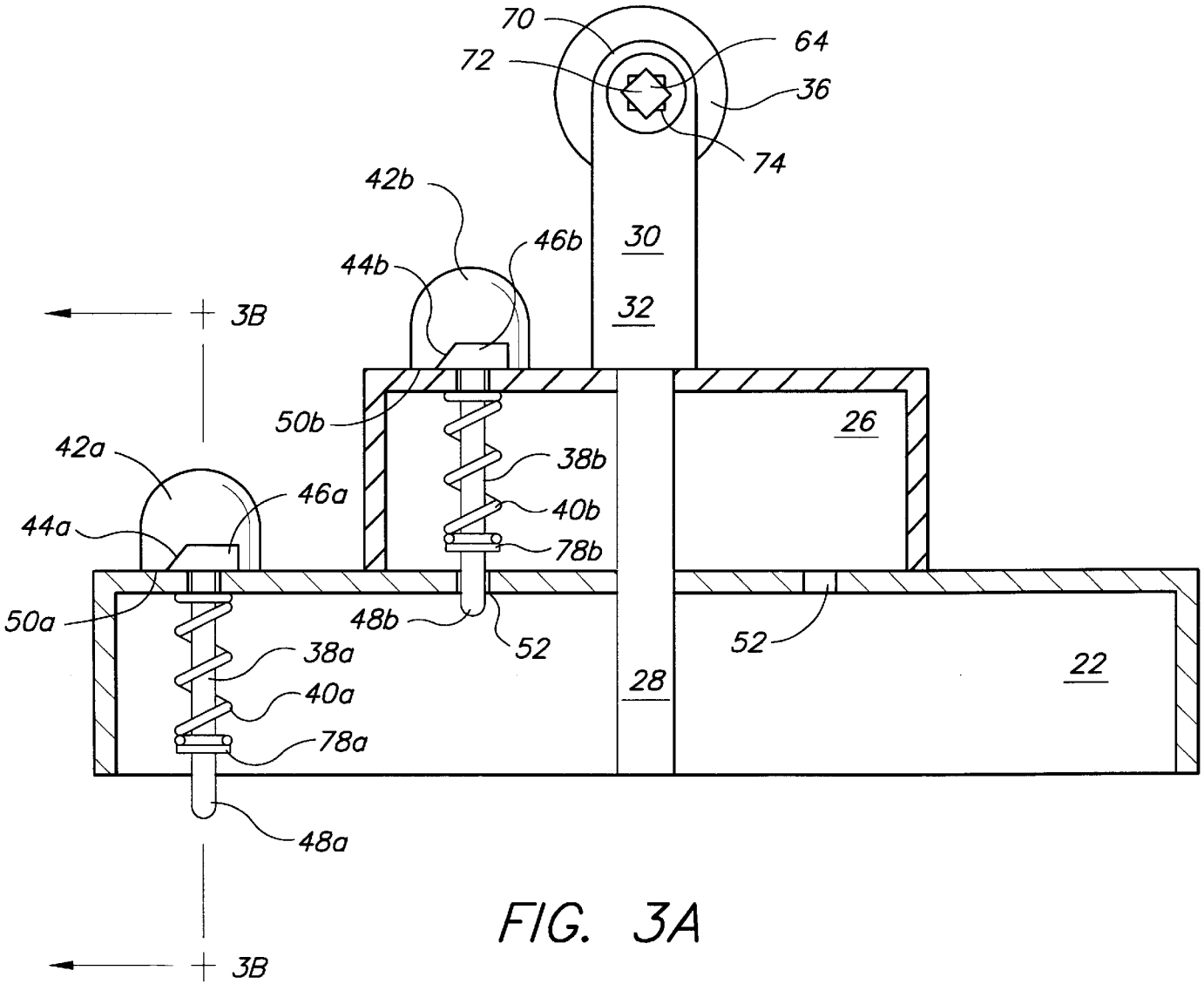
FIG. 3A is a side cross sectional view of a handgrip assembly for a push-up trainer according to the present invention, showing the sliding member and rotating plate secured in place.
Figure 3B:
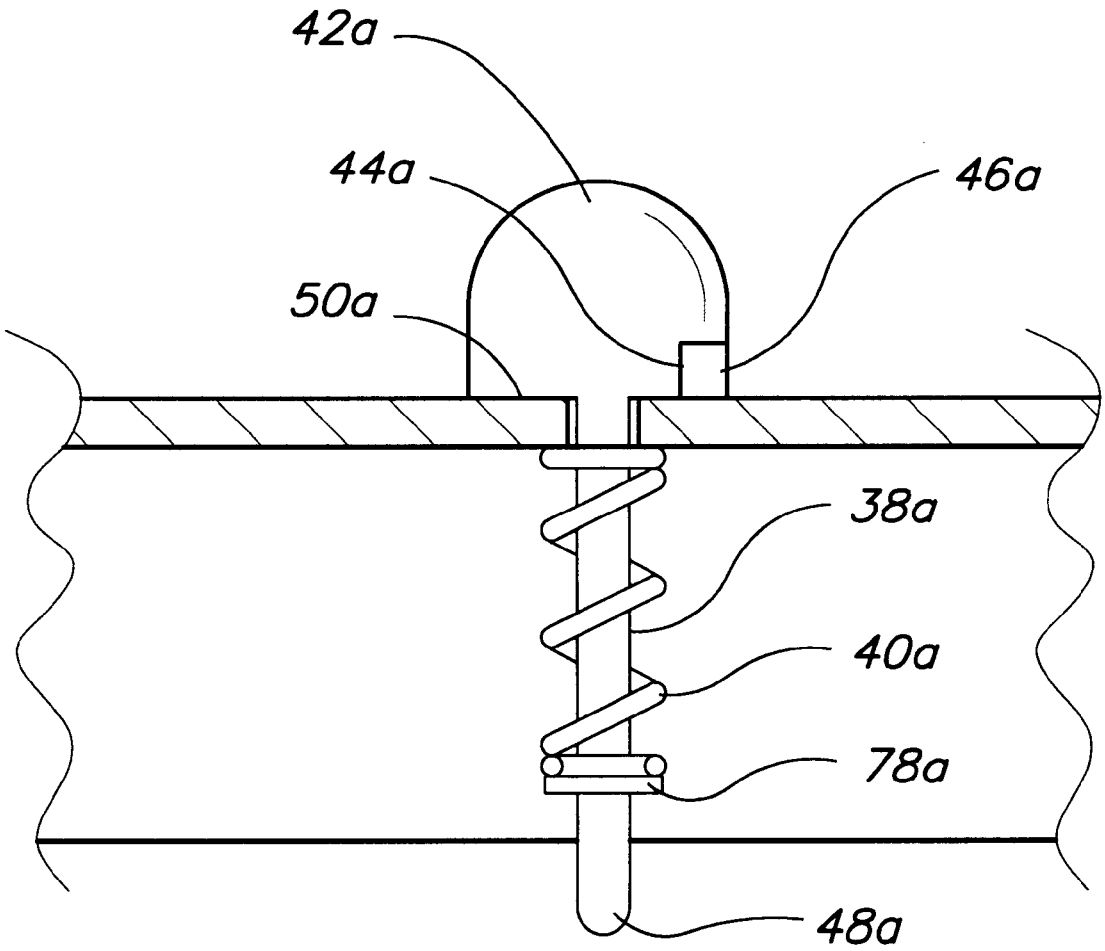
FIG. 3B is a fragmented, end cross sectional view of the sliding member, showing details of the locking pin in the locked position along line 3B—3B of FIG. 3A.
Figure 4A:
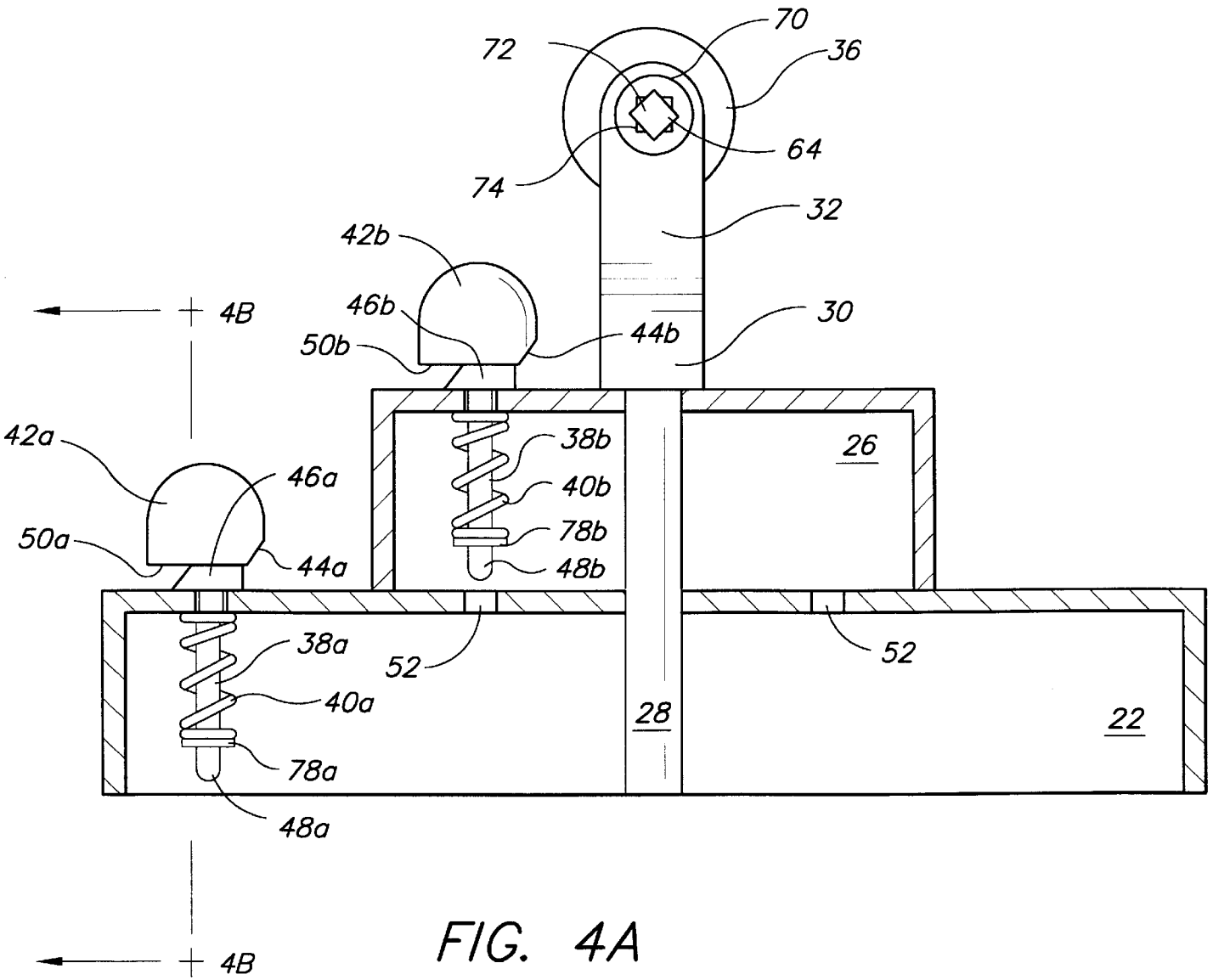
FIG. 4A is a side cross sectional view of a handgrip assembly for a push-up trainer according to the present invention, showing the sliding member free to slide, and the rotating plate free to rotate.
Figure 4B:
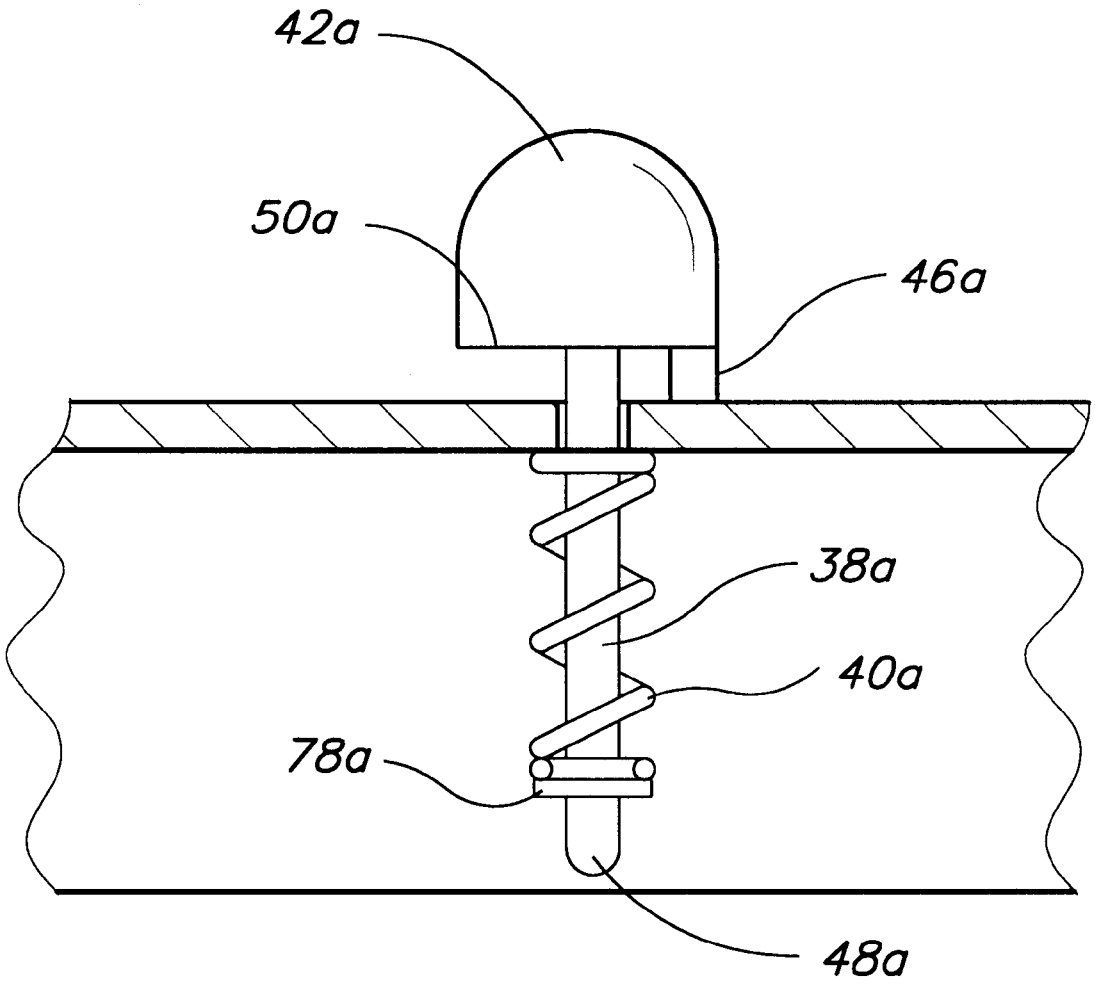
FIG. 4B is a fragmented, end cross sectional view of the sliding member, showing details of the locking pin in the unlocked position along line 4B—4B of FIG. 4A.

The present invention is a pushup trainer. Referring to FIGS. 1 and 2, the pushup trainer 10 has an elongated base 12 and a pair of slidably mounted handgrip assemblies 14,16, slidably mounted within the base. The base includes a flat top surface 18, preferably having a low coefficient of friction, and a lip, 20, surrounding the outside of the top surface 18. The lip 20 extends upward from the edges of the top surface 18, and then extends inward to lip over the top edges of the sliding members 22 of handgrip assemblies 14,16. The top surface 18 of base 12 includes a row of holes 24 extending linearly between the ends 80 of top surface 18.

Referring to FIGS. 3A, 3B, 4A and 4B, an individual handgrip assembly 14,16 is shown. Sliding member 22 forms the bottom of the handgrip assemblies 14,16, with rotating plate 26 secured to sliding member 22 by vertical shaft 28. Brace 30 is secured to the top of rotating plate 26. Brace 30 includes arms 32,34, securing handgrip 36 therebetween.

Sliding member 22 is slightly elongated in the same direction as the base 12, with flat sides 82 fitting within lips 20, thereby securing sliding member 22 to base 12, and preventing sliding member 22 from rotating with respect to base 12. Sliding member 22 preferably has a low coefficient of friction, particularly where it contacts the base 12 and any other rotatably contacting surfaces. Sliding member 22 includes locking pin 38*a*, which fits within holes 24 in base 12 to prevent sliding member 22 from sliding. Spring 40*a*, with its end resting on plate 78*a* near end 48*a* of locking pin 38*a*, biases locking pin 38*a* in the locked position. Knob 42*a*, on top of locking pin 38*a*, can be grasped to retract locking pin 38*a*. Knob 42*a* defines cutout 44*a* along its lower edge, corresponding to shelf 46*a*, attached to the top surface of sliding member 22. When pin 38*a* is in the locked position, shelf 46*a* fits within cutout 44*a*, and the end 48*a* of pin 38*a* protrudes from the bottom of the sliding member 22, fitting within one of the holes 24 in base 12. When pin 38*a* is retracted and rotated, the edge 50*a* of knob 42*a* rests on shelf 46*a*, securing pin 38*a* in the unlocked position, wherein end 48*a* of pin 38*a* does not protrude from sliding member 22, and sliding member 22 is free to slide laterally within housing 12. Sliding member 22 also includes holes 52 in its top surface, with holes 52 defining a circle around and being equidistant from shaft 28.

Rotating plate 26 is attached to sliding member 22 by shaft 28. Rotating plate 26 is preferably round, preventing any interference with lips 20 during rotation, and preferably has a low coefficient of friction. Like sliding member 22, rotating plate 26 includes locking pin 38*b*, which fits within holes 52 in sliding member 22 to prevent rotating plate 26 from rotating. Spring 40*b*, with its end resting on plate 78*b* near end 48*b* of locking pin 38*b*, biases locking pin 38*b* in the locked position. Knob 42*b*, on top of locking pin 38*b*, can be grasped to retract locking pin 38*b*. Knob 42*b* defines cutout 44*b* along its lower edge, corresponding to shelf 46*b*, attached to the top surface of sliding member 22. When pin 38*b* is in the locked position, shelf 46*b* fits within cutout 44*b*, and the end 48*b* of pin 38*b* protrudes from the bottom of the rotating plate 26, fitting within one of the holes 52 in sliding member 22. When pin 38*b* is retracted and rotated, the edge 50*b* of knob 42*b* rests on shelf 46*b*, securing pin 38*b* in the unlocked position, wherein end 48*b* of pin 38*b* does not protrude from rotating plate 26, and rotating plate 26 is free to rotate within a horizontal plane around shaft 28.

Figure 5:
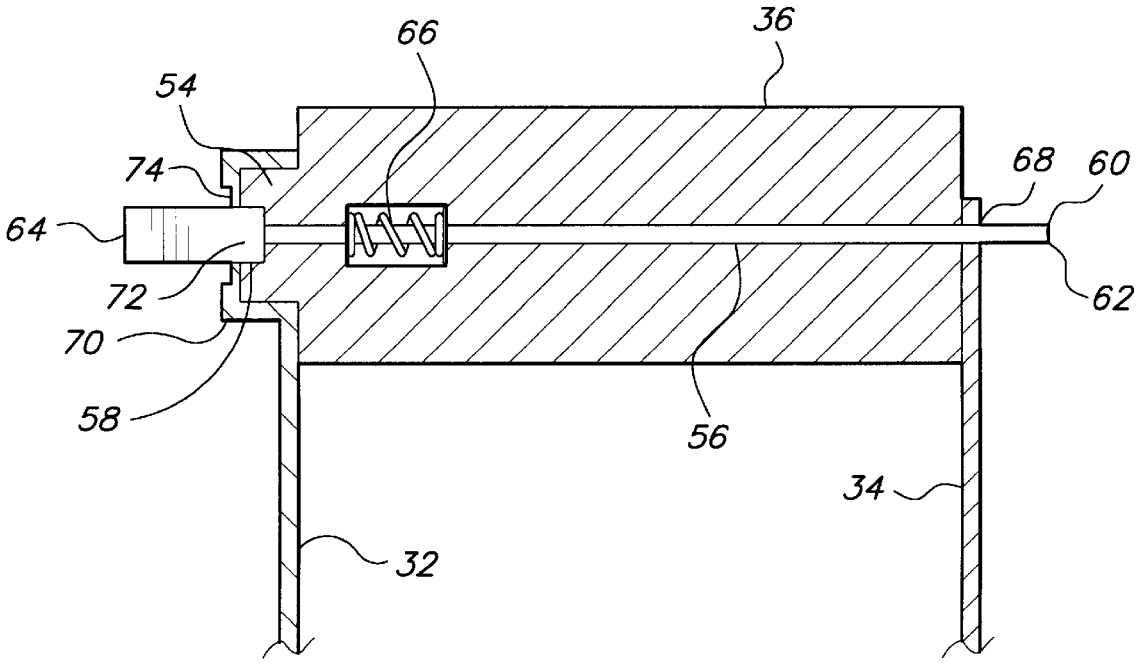
FIG. 5 is a side cross sectional view of the handle and handle brace, showing the handle's locking pin in the locked position.
Figure 6:
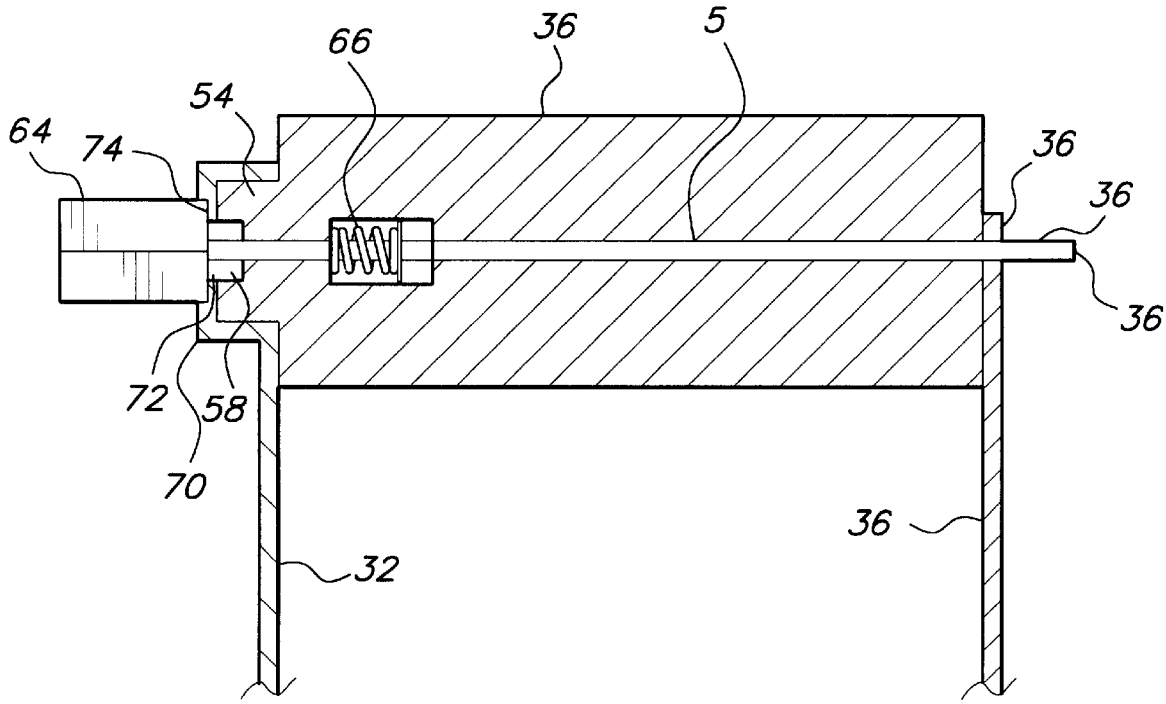
FIG. 6 is a side cross sectional view of the handle and handle brace, showing the handle's locking pin in the unlocked position.

Referring to FIGS. 5 and 6, handle 36 is supported between arms 32,34 of brace 30. Handle 36 is an elongated cylinder with a first end having a round protrusion 54 with a smaller diameter than the rest of the cylinder. A central bore 56 corresponds to the longitudinal axis of the cylinder. The central bore is round, but has a square hole 58 within the protrusion 54. Although a square hole 58 is preferred, many other noncircular shaped holes 58 can be utilized with equal effectiveness. Handle pin 60 is contained within central bore 56, with a round portion 62 corresponding to the round portion of central bore 56, and a square knob 64 corresponding to square hole 58. The handle pin is biased by spring 66 so that the square knob 64 fits within square hole 58.

Arm 34 includes a round hole 68, and arm 32 includes a round recessed portion 70 for receiving round protrusion 54 of handle 36. The recessed portion 70 includes a square hole 72 for receiving square knob 64, and a square indentation 74, having the same center as square hole 72 but rotated 45° from square hole 72. Handle pin 60 passes through round hole 68, central bore 56 including square hole 58, and square hole 72 in arm 32. Handle 36 is thereby supported at arm 34 by handle pin 60, and at arm 32 by round protrusion 54. When handle pin 60 is in the locked position, square knob 64 fits within the handle's square hole 58 and the square hole 72 in arm 32, thereby preventing rotation of handle 36 relative to arms 32,34. When square knob 64 is retracted, rotated 45°, and placed within square indentation 74, it is biased into indentation 74 by spring 66, preventing square knob 54 from entering square holes 58,72, and allowing the handle 36 to rotate freely around handle pin 60.

It should be noted that, if a shape other than square is used for the handle pin's knob 64 and corresponding holes, the indentation 74 need not be rotated 45° from hole 72, but may be rotated to any degree sufficient to secure knob 64 in the unlocked position.

To use the invention, the user 76 first decides the level and type of difficulty he wishes to add to his pushups. If the user 76 wants to force himself to control the lateral sliding motion of the handles, he retracts the locking pins 38 of sliding member 22, thereby permitting the sliding member 22 to slide laterally within base 12. Otherwise, he inserts the locking pins 38 of sliding member 22 into holes 24, locking the sliding members in place. If the user 76 wants to force himself to control rotation of the handgrips 36 in a horizontal plane, he retracts the locking pins 38 of rotating plate 26, thereby allowing rotating plate 26 to rotate horizontally. Otherwise, he inserts the locking pins 38 of the rotating plate 26 into the holes 52, thereby locking rotating plate 26 in position with respect to sliding member 22. If the user 76 chooses to lock rotating plate 26 in place, he may first orient the handle 36 so that it is either parallel to or perpendicular to the base 12. Lastly, if the user 76 wants to force himself to control the rotation of the handgrips around their axis, he retracts the handle pins 60, thereby allowing the handles to rotate. Otherwise, he inserts pins 60, thereby locking the handgrips in place. User 76 then assumes a pushup position, grasping a handle 36 in each hands, and proceeds to perform pushups up to his level of fitness.

It is to be understood that the present invention is not limited to the embodiment described above, but encompasses any and all embodiments within the scope of the following claims.

I claim:

1. A push-up trainer comprising:

an elongated base having a top surface with a pair of ends, an edge, a lip extending upward from said top surface's edge and inward over said top surface, and a plurality of holes within said top surface extending linearly between said ends, said top surface having a low coefficient of friction;

a pair of handle assemblies, each of said handle assemblies comprising:

a sliding member slidably mounted on said base's top surface, said sliding member having a pair of flat side edges fitting within said lips, said sliding member having a low coefficient of friction, said sliding member having a rotating shaft and a plurality of holes surrounding and equidistant from said shaft, said sliding member further having a locking pin corresponding to said holes in said base's top surface, said locking pin having an end, said locking pin having a locked position wherein said end fits within said holes in said base's top surface, and an unlocked position wherein said end is retracted from said holes in said base, and said sliding member including means for securing said locking pin in said locked and said unlocked positions;

a rotating plate rotatably attached to said sliding member's rotating shaft, said rotating plate being round and having a low coefficient of friction, said rotating plate further having a locking pin corresponding to said holes in said sliding member, said locking pin having an end said rotating plate having a shelf corresponding to said cutout, said locking pin having a locked position wherein said end fits within said holes in said sliding member, and an unlocked position wherein said end is retracted from said holes in said sliding member, and said rotating plate including means for securing said locking pin in said locked and said unlocked positions;

a handle, said handle being elongated and having a first end, a second end, and a diameter, said first end having a round protrusion having a smaller diameter than said handle, said handle having a central bore, said central bore being round at said second end, and having a noncircular portion at said first end, said handle having a handle pin fitting within said central bore, said handle pin being round with a noncircular knob, said noncircular knob being dimensioned and configured to fit within said noncircular portion of said central bore;

a first and second arm upwardly depending from said rotating plate, said second arm defining a round hole, said first arm defining a round recessed portion dimensioned and configured to support said handle's round protrusion, said recessed portion having a noncircular hole and a noncircular indentation rotated away from said noncircular hole, said noncircular hole and noncircular indentation being dimensioned and configured to receive said handle pin's knob; and said handle pin having a locked position wherein said handle pin's knob fits within said noncircular portion of said central bore and said first arm's noncircular hole, and an unlocked position wherein said handle fits within said noncircular indentation of said first arm, said handle pin being spring biased towards said locked position.

2. The push-up trainer according to claim 1, wherein each of said pair of sliding members is elongated in the same direction as said base.

3. The push-up trainer according to claim 1, wherein said means for biasing said locking pins in said locked positions comprise a spring.

4. The push-up trainer according to claim 1, wherein each of said locking pins on said sliding members further comprise a knob opposite said end.

5. The push-up trainer according to claim 4, wherein said means for biasing said locking pins in said unlocked positions comprise:

said knobs each defining a cutout;

each of said sliding members including a shelf dimensioned and configured to fit within said cutout; and said shelf fitting within said cutout when said locking pin is in said locked position, and said knob sitting on top of said shelf when said pin is in said unlocked position.

6. The push-up trainer according to claim 1, wherein each of said locking pins on said rotating plates further comprise a knob opposite said end.

7. The push-up trainer according to claim 6, wherein:

said knobs each define a cutout;

each of said rotating plates includes a shelf dimensioned and configured to fit within said cutout; and said shelf fits within said cutout when said locking pin is in said locked position, and said knob sits on top of said shelf when said pin is in said unlocked position.

8. The push-up trainer according to claim 1, wherein said handle is cylindrical.

9. The push-up trainer according to claim 1, wherein said central bore's noncircular portion, said handle pin's knob, and said first arm's hole and indentation are square.

10. The push-up trainer according to claim 9, wherein said first arm's indentation is rotated 45° from said first arm's hole.

11. A push-up trainer comprising:

an elongated base having a top surface with a pair of ends, an edge, a lip extending upward from said top surface's edge and inward over said top surface, and a plurality of holes within said top surface extending linearly between said ends, said top surface having a low coefficient of friction;

a pair of handle assemblies, each of said handle assemblies comprising:

a sliding member slidably mounted on said base's top surface, said sliding member being elongated in the same direction as said base, said sliding member having a pair of flat side edges fitting within said lips, said sliding member having a low coefficient of friction, said sliding member having a rotating shaft and a plurality of holes surrounding and equidistant from said shaft, said sliding member further having a locking pin corresponding to said holes in said base's top surface, said locking pin having an end and a knob opposite said end, said knob having a cutout, said sliding member having a shelf corresponding to said cutout, said locking pin having a locked position wherein said end fits within said holes in said base's top surface and said shelf fits within said cutout, and an unlocked position wherein said end is retracted from said holes in said base and said knob sits atop said shelf, and said locking pin being spring-biased in said locked position;

a rotating plate rotatably attached to said sliding member's rotating shaft, said rotating plate being round and having a low coefficient of friction, said rotating plate further having a locking pin corresponding to said holes in said sliding member, said locking pin having an end and a knob opposite said end, said knob having a cutout, said rotating plate having a shelf corresponding to said cutout, said locking pin having a locked position wherein said end fits within said holes in said sliding member and said shelf fits within said cutout, and an unlocked position wherein said end is retracted from said holes in said sliding member and said knob sits atop said shelf, and said locking pin being spring-biased in said locked position;

a handle, said handle being an elongated cylinder having a first end, a second end, and a diameter, said first end having a round protrusion having a smaller diameter than said cylinder, said handle having a central bore, said central bore being round at said second end, and having a square portion at said first end, said handle having a handle pin fitting within said central bore, said handle pin being round with a square knob, said square knob being dimensioned and configured to fit within said square portion of said central bore;

a first and second arm upwardly depending from said rotating plate, said second arm defining a round hole, said first arm defining a round recessed portion dimensioned and configured to support said handle's round protrusion, said recessed portion having a square hole and a square indentation rotated 45° from said square hole, said square hole and square indentation being dimensioned and configured to receive said handle pin's square knob; and said handle pin having a locked position wherein said square knob fits within said square portion of said central bore and said first arm's square hole, and an unlocked position wherein said handle fits within said square indentation of said first arm, said handle pin being spring biased towards said locked position.

* * * * *